US009962827B2

(12) United States Patent
Kao

(10) Patent No.: US 9,962,827 B2
(45) Date of Patent: May 8, 2018

(54) HAND TOOL FRAME

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 0 days. days.

(21) Appl. No.: 15/079,529

(22) Filed: Mar. 24, 2016

(65) Prior Publication Data

US 2017/0274522 A1 Sep. 28, 2017

(51) Int. Cl.
*B25H 3/04* (2006.01)

(52) U.S. Cl.
CPC ..... *B25H 3/04* (2013.01)

(58) Field of Classification Search
CPC ..... B25H 3/04
USPC ..... 211/70.6
See application file for complete search history.

(56) References Cited

U.S. PATENT DOCUMENTS 1,712,473 A * 5/1929 McWethy ..... B25H 3/003 206/378
3,726,393 A * 4/1973 Thompson ..... A47F 7/0028 206/378
3,980,384 A * 9/1976 Lawson ..... H01R 9/2408 439/710
4,337,860 A * 7/1982 Carrigan ..... B25H 3/003 206/376
4,768,660 A * 9/1988 Handler ..... A47F 5/0846 211/106.01
4,781,608 A * 11/1988 Hillmann ..... B60M 1/307 211/94.01
5,165,629 A * 11/1992 Breveglieri ..... A47F 5/0884 211/60.1
5,228,570 A * 7/1993 Robinson ..... B25B 13/56 206/375
5,467,874 A * 11/1995 Whitaker ..... B25B 23/0035 206/378
5,645,177 A * 7/1997 Lin ..... B25H 3/04 206/378
5,715,951 A * 2/1998 Dembicks ..... B25B 13/56 206/378
5,855,285 A * 1/1999 Laird ..... B25H 3/003 206/378
6,070,745 A * 6/2000 Dembicks ..... B25H 3/06 206/378
6,168,018 B1 * 1/2001 Ramsey ..... B25H 3/06 206/378
6,431,373 B1 * 8/2002 Blick ..... B25H 3/003 206/378
6,488,151 B2 * 12/2002 Ramsey ..... B25H 3/06 206/378
7,108,132 B2 * 9/2006 Shih ..... B25B 13/56 206/378

(Continued)

*Primary Examiner* — Stanton L Krycinski
(74) *Attorney, Agent, or Firm* — C. G. Mersereau; Nikolai & Mersereau, P.A.

(57) ABSTRACT

A hand tool frame has a track base and at least one positioning mount. The track base has a bottom panel and a slide rail. The bottom panel has multiple positioning holes formed through the bottom panel. The at least one positioning mount is slidably mounted on the track base, and each one of the at least one positioning mount has a sliding seat and an extending element. The sliding seat is slidably mounted in the slide rail and engages with one of the multiple positioning holes. The extending element is formed on the sliding seat and extends out of the slide rail. Then, the at least one positioning mount may engage with the track base at a specific position.

10 Claims, 20 Drawing Sheets

(56) References Cited

U.S. PATENT DOCUMENTS

| | | | | |
|---|---|---|---|---|
| 7,669,723 | B2 * | 3/2010 | Kao | B25H 3/04 206/349 |
| 7,717,278 | B2 * | 5/2010 | Kao | B25H 3/04 206/349 |
| 7,753,216 | B2 * | 7/2010 | Kao | B25H 3/04 211/70.6 |
| 7,931,159 | B2 * | 4/2011 | Kao | A47F 5/0838 211/70.6 |
| 8,403,155 | B1 * | 3/2013 | Kao | B25H 3/04 206/376 |
| 2005/0247653 | A1 * | 11/2005 | Brooks | A47F 5/0846 211/94.01 |

* cited by examiner

HAND TOOL FRAME

BACKGROUND OF THE INVENTION

1. Field of the Invention

The present invention relates to a hand tool frame, and more particularly to a hand tool frame that may provide a positioning effect to hand tools that are mounted on the hand tool frame and may improve the practicality of the hand tool frame.

2. Description of Related Art

With reference to FIG. 19, a conventional hand tool frame 80 has a track base 81 and at least one pair of positioning mounts 82. The track base 81 is an elongated seat and has a top side and a slide rail 811. The slide rail 811 is formed in the top side of the track base 81. Each one of the at least one pair of positioning mounts 82 is slidably mounted in the slide rail 811 of the track base 81, and has a sliding seat 821 and an extending element 822. The sliding seat 821 is slidably mounted in the slide rail 811 and has a top surface. The extending element 822 is formed on and protrudes from the top surface of the sliding seat 821, and is a clamping arm.

Then, with reference to FIG. 20, different kinds of hand tools such as pliers 90, combination spanners 91, adjustable wrenches 92, socket wrenches 93, hexagonal wrenches 94 or screwdrivers 95 may be inserted into a holding space that is formed between the clamping arms of the at least one pair of positioning mounts 82.

However, each one of the at least one pair of positioning mounts 82 does not engage with the track base 81. Therefore, each one of the at least one pair of positioning mounts 82 may move relative to the track base 81 during insertion of the different kinds of hand tools. A width of the holding space between the clamping arms of the at least one pair of positioning mounts 82 may increase since the hand tools are pushing the extending elements 822. The different kinds of hand tools may fall from the conventional tool frame 80, which is very inconvenient in use.

To overcome the shortcomings, the present invention tends to provide a hand tool frame to mitigate the aforementioned problems.

SUMMARY OF THE INVENTION

The present invention relates to a hand tool frame, and more particularly to a hand tool frame that may provide a positioning effect to hand tools that are mounted on the hand tool frame and may improve the practicality of the hand tool frame.

The hand tool frame has a track base and at least one positioning mount. The track base has a bottom panel and a slide rail. The bottom panel has multiple positioning holes formed through the bottom panel. The at least one positioning mount is slidably mounted on the track base, and each one of the at least one positioning mount has a sliding seat and an extending element. The sliding seat is slidably mounted in the slide rail and engages with one of the multiple positioning holes. The extending element is formed on the sliding seat and extends out of the slide rail. Then, the at least one positioning mount may engage with the track base at a specific position.

Other objects, advantages, and novel features of the invention will become more apparent from the following detailed description when taken in conjunction with the accompanying drawing.

DETAILED DESCRIPTION OF PREFERRED EMBODIMENT

Figure 1:
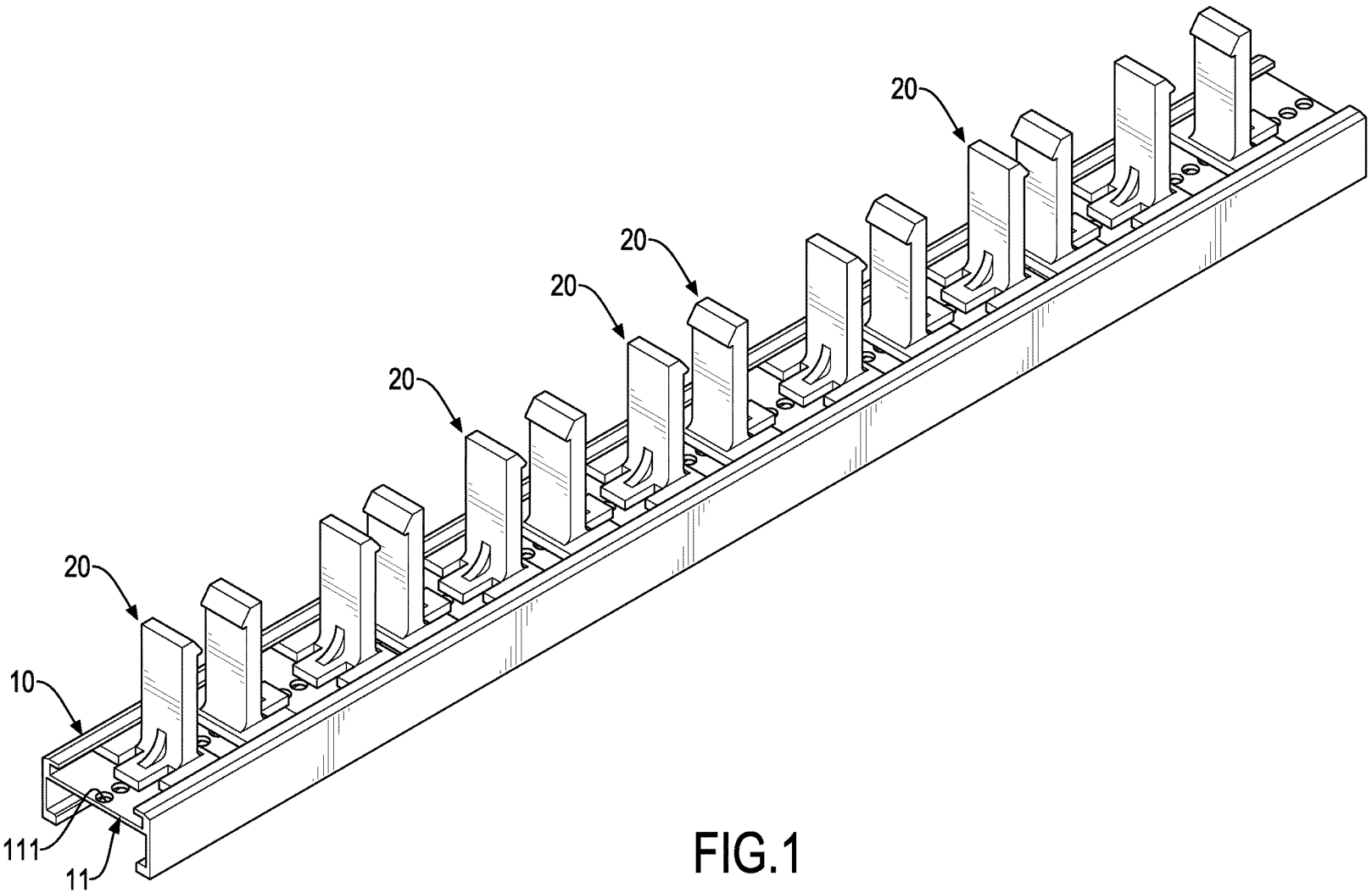
FIG. 1 is a perspective view of a first embodiment of a hand tool frame in accordance with the present invention.
Figure 2:
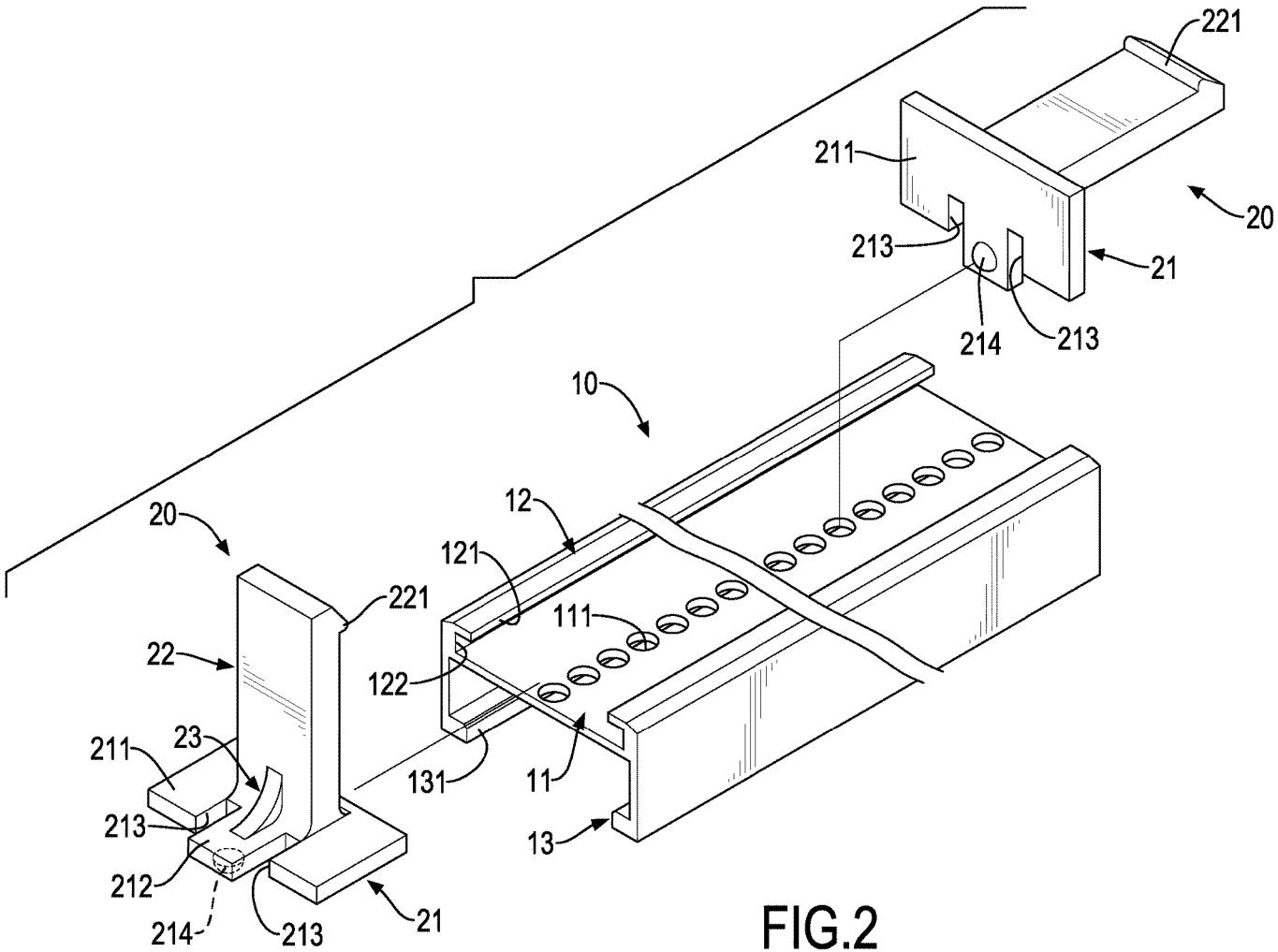
FIG. 2 is an enlarged and exploded perspective view of the hand tool frame in FIG. 1.
Figures 3, 3A, 3B:
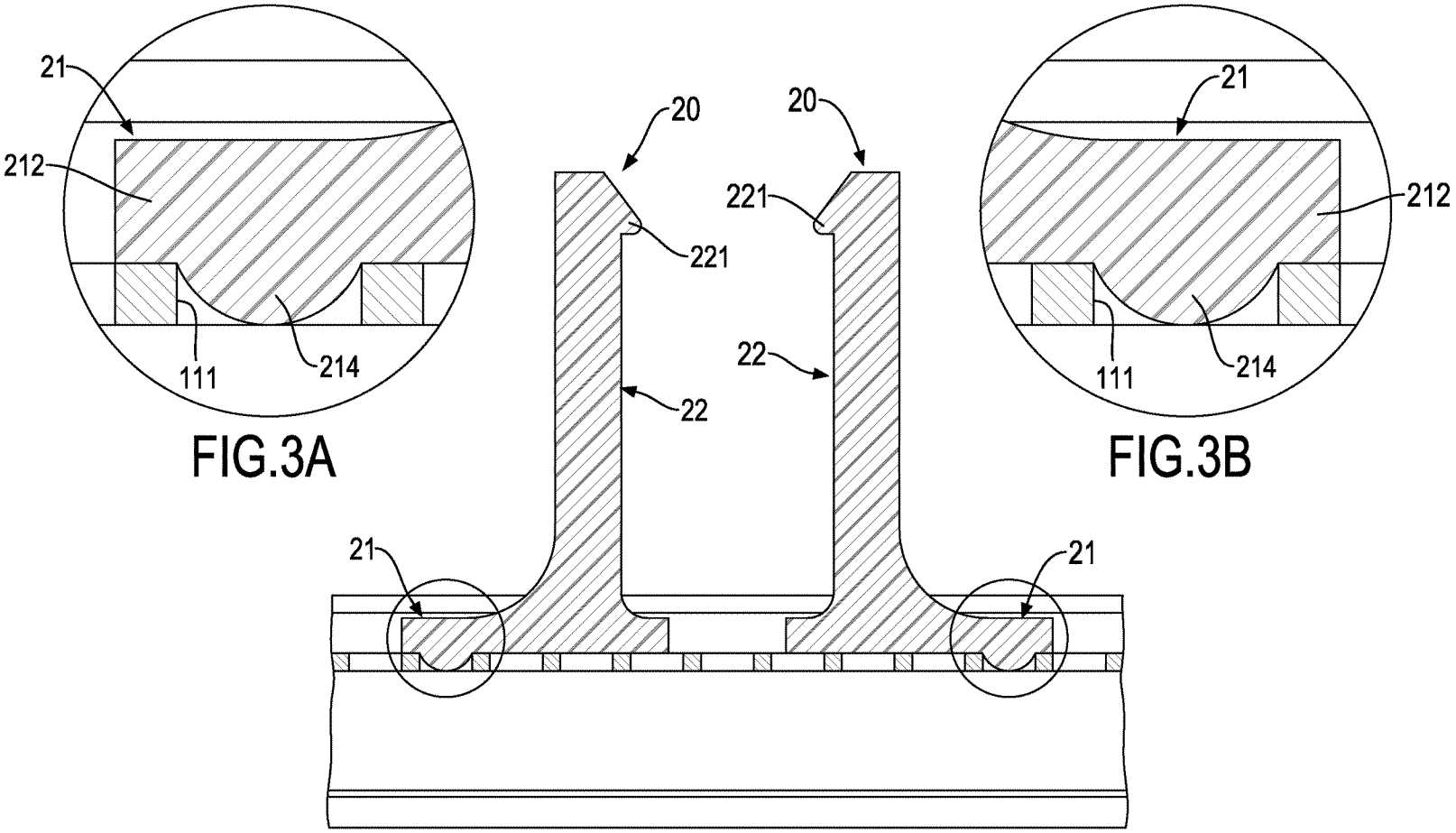
FIG. 3 is an enlarged side view of the hand tool frame in FIG. 1.
FIGS. 3A and 3B are enlarged side views of the hand tool frame in FIG. 3.

With reference to FIGS. 1 to 3, a first embodiment of a hand tool frame in accordance with the present invention comprises a track base 10 and at least one pair of positioning mounts 20.

The track base 10 is made of aluminum, is an elongated seat and has a bottom panel 11, a slide rail 12, and a closed track 13. The bottom panel 11 has a top surface, a bottom surface, a front end, a rear end, and multiple positioning holes 111. The multiple positioning holes 111 are formed through the bottom panel 11 at spaced intervals between the front end and the rear end of the bottom panel 11. The slide rail 12 is formed on and protrudes from the top surface of the bottom panel 11 between the front end and the rear end of the bottom panel 11 and has a top side, a top opening 121, and a sliding recess 122. The top opening 121 is formed through the top side of the slide rail 12. The sliding recess 122 is formed in the slide rail 12 between the top side of the slide rail 12 and the top surface of the bottom panel 11 and communicates with the top opening 121 and the multiple positioning holes 111.

The closed track 13 is formed on and protrudes from the bottom surface of the bottom panel 11 and has a bottom side and a bottom opening 131. The bottom opening 131 is formed through the bottom side of the closed track 13 and communicates with the multiple positioning holes 111. In addition, the closed track 13 and the slide rail 12 are formed on the bottom panel 11 as a single piece.

The at least one pair of positioning mounts 20 are slidably mounted on the track base 10, and each one of the at least one pair of positioning mounts 20 has a sliding seat 21, an extending element 22, and a supporting rib 23. The sliding seat 21 is slidably mounted in the sliding recess 122 of the slide rail 12, and engages with one of the multiple positioning holes 111. The sliding seat 21 has a body 211, a positioning portion 212, two engaging slots 213, and an engaging segment 214.

The body 211 is U-shaped, is slidably mounted in the sliding recess 122 of the slide rail 12 and has a bottom surface, a top surface, two free ends, and a middle segment. The bottom surface of the body 211 faces the sliding recess 122 of the slide rail 12 and abuts the top surface of the bottom panel 11. The top surface of the body 211 faces the top opening 121 of the slide rail 12. The middle segment is formed between the two free ends of the body 211.

The positioning portion 212 is formed on and protrudes from the middle segment of the body 211. The positioning portion 212 is elastic, and has a top surface and a bottom surface. The bottom surface of the positioning portion 212 faces the bottom panel 11. The two engaging slots 213 are respectively formed through the body 211 between the free ends of the body 211 and the positioning portion 212, and this makes the positioning portion 212 elastomeric. With further reference to FIGS. 3, 3A, and 3B, the engaging segment 214 is formed on and protrudes downwardly from the bottom surface of the positioning portion 212, and selectively engages with one of the multiple positioning holes 111 of the bottom panel 11. Then, the sliding seat 21 may engage with the track base 10 at a specific position. In addition, the engaging segment 214 is hemispherical.

The extending element 22 is formed on and protrudes upwardly from the top surface of the body 211. The extending element 22 is a clamping arm and has an inner surface, an outer surface, a free end, and a holding hook 221. The inner surfaces of the extending elements 22 of the at least one pair of positioning mounts 20 face to each other. The outer surface of the extending element 22 is opposite to the inner surface of the extending element 22. The free end of the extending element 22 extends out of the slide rail 12 via the top opening 121, and the holding hook 221 is formed on the inner surface of the extending element 22 at the free end of the extending element 22. The holding hooks 221 of the at least one pair of positioning mounts 20 face to each other, and a holding space is formed between the extending elements 22 of the at least one pair of positioning mounts 20. The supporting rib 23 is formed on the top surface of the body 211 of the sliding seat 21 and the outer surface of the extending element 22 to enhance the connecting structural strength between the sliding seat 21 and the extending element 22.

Figure 4:
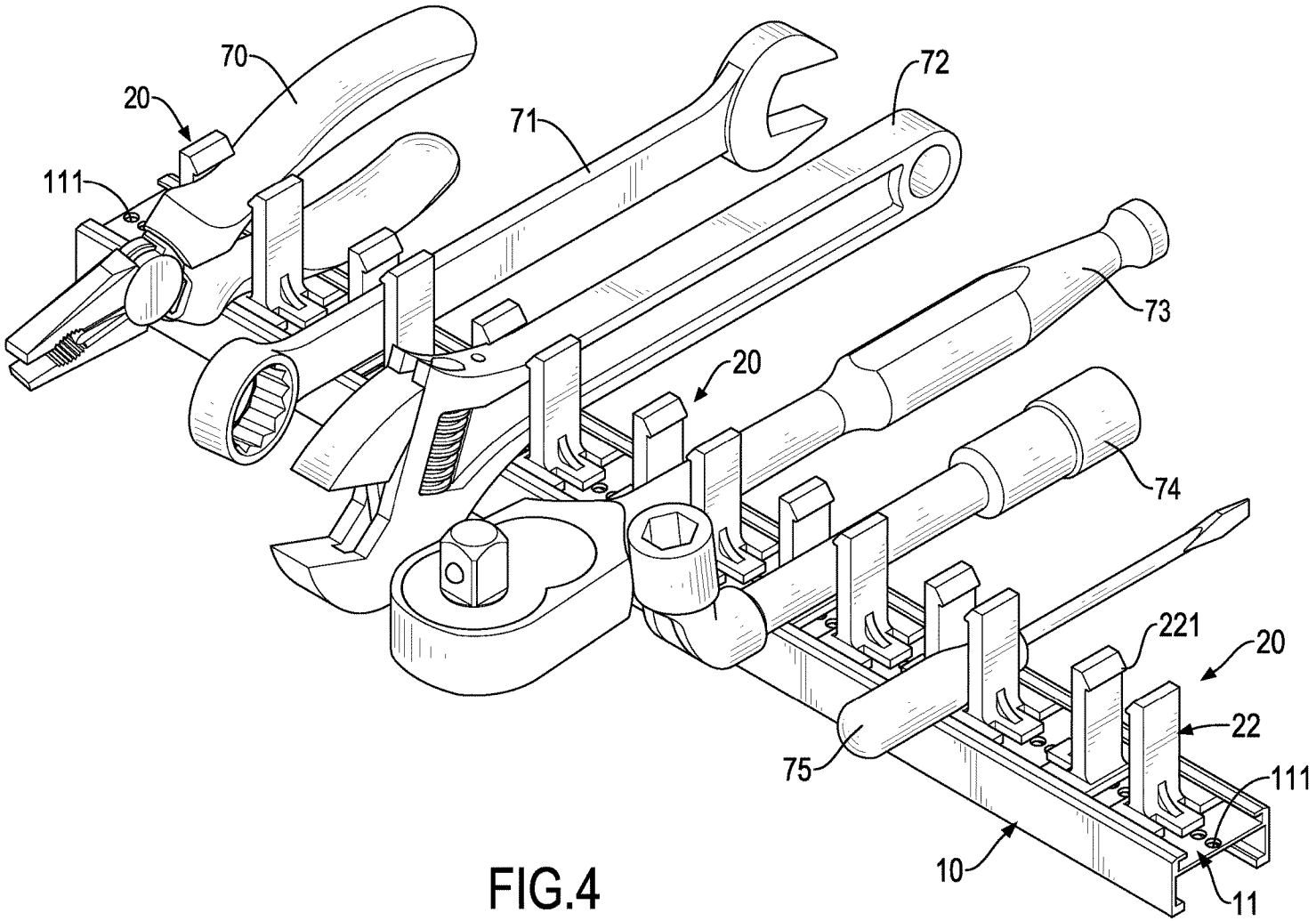
FIG. 4 is an operational perspective view of the hand tool frame in FIG. 1, shown with pliers, combination spanners, adjustable wrenches, socket wrenches, hexagonal wrenches, and screwdrivers mounted on the hand tool frame.

With reference to FIG. 4, when the hand tool frame of the first embodiment in the present invention is in use, different kinds of hand tools such as pliers 70, combination spanners 71, adjustable wrenches 72, socket wrenches 73, hexagonal wrenches 74 or screwdrivers 75 may be inserted into the holding space that is formed between the extending elements 22 of the at least one pair of positioning mounts 20, and the holding hooks 221 may prevent the hand tool separating from the at least one pair of positioning mounts 20. Furthermore, the holding space between the extending elements 22 of the at least one pair of positioning mounts 20 may be adjusted by moving the sliding seats 21 of the at least one pair of positioning mounts 20 along the multiple positioning holes 111 relative to the track base 10. After adjusting the holding space between the at least one pair of positioning mounts 20, the at least one pair of positioning mounts 20 may be positioned on the bottom panel 11. Then, the different kinds of hand tools may be held securely on the track base 10 by the at least one pair of positioning mounts 20 and this will improve the practicality of the hand tool frame.

Figure 5:
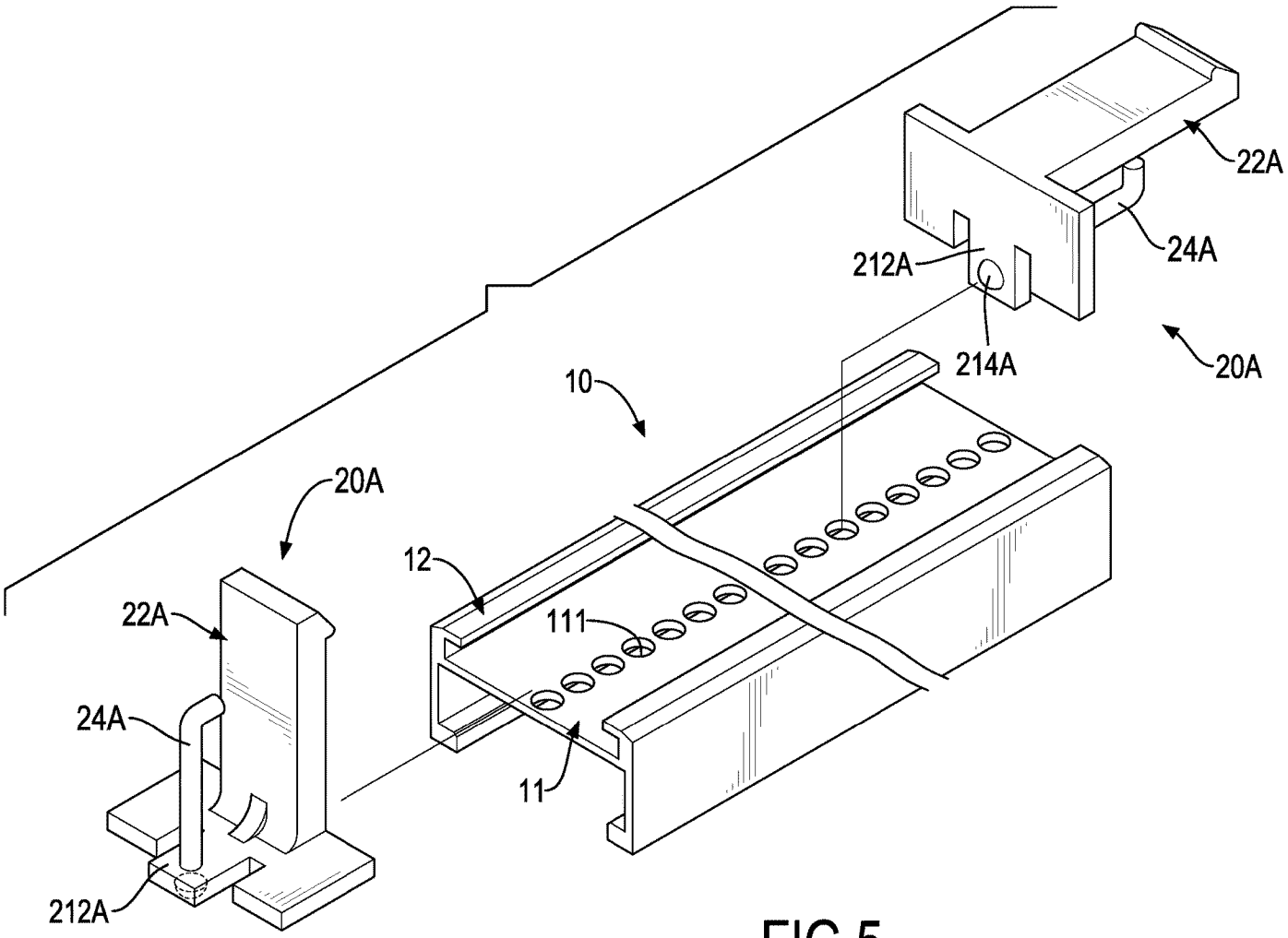
FIG. 5 is an enlarged and exploded perspective view of a second embodiment of a hand tool frame in accordance with the present invention.

With reference to FIG. 5, a second embodiment of a hand tool frame in accordance with the present invention is substantially the same as the first embodiment except for the following features. Each one of the at least one pair of positioning mounts 20A further has a pressing arm 24A. The pressing arm 24A is formed on and protrudes upwardly from the top surface of the positioning portion 212A, and is L-shaped.

Figure 6:
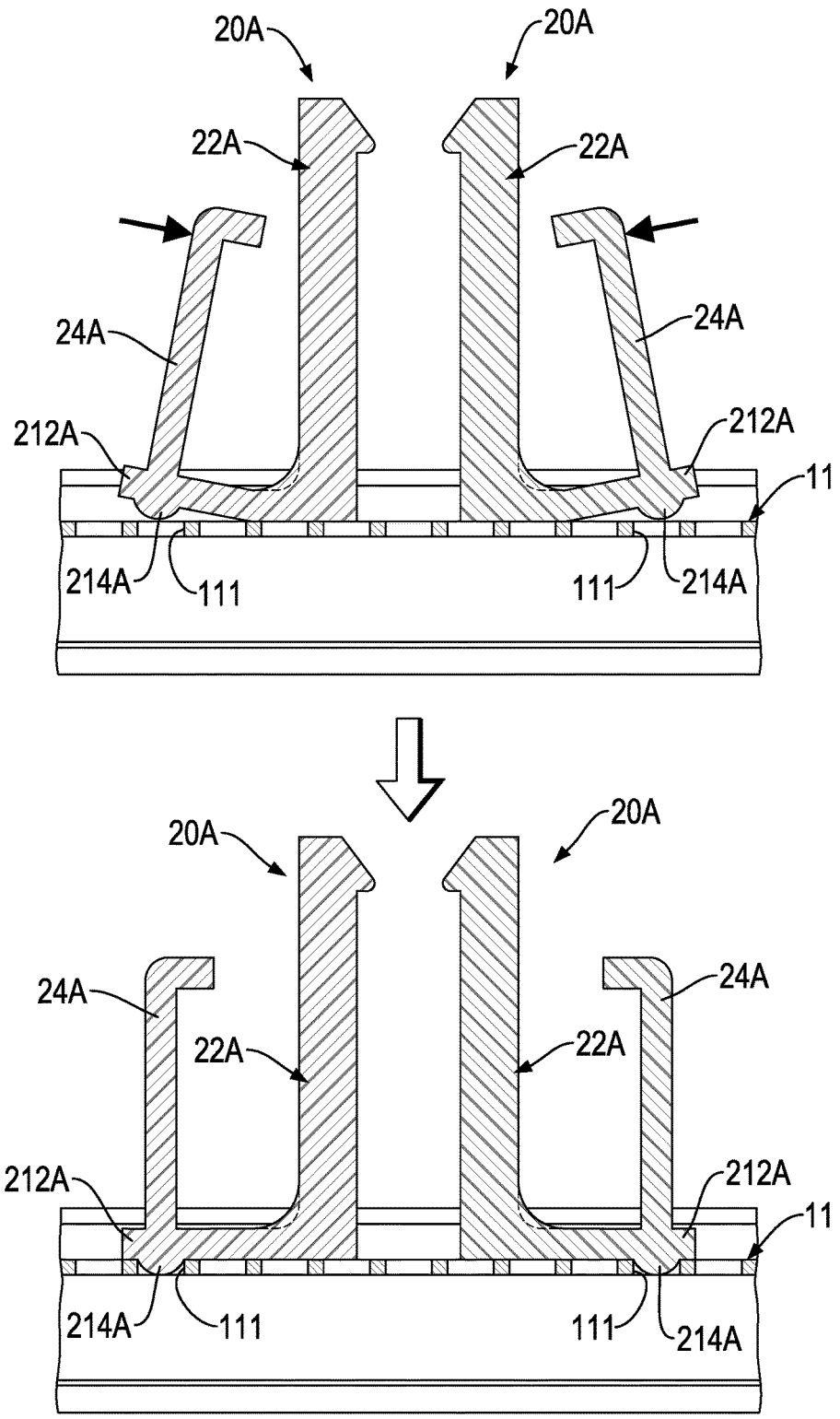
FIG. 6 is an operational and enlarged side view of the hand tool frame in FIG. 5.

With reference to FIG. 6, when the hand tool frame of the second embodiment in the present invention is in use, a user may press the pressing arm 24A of the positioning mount 20A toward the extending element 22A, and the positioning portion 212A move upwardly, and this makes the engaging segment 214A disengage from a corresponding positioning hole 111 of the bottom panel 11. Therefore, the positioning mount 20A may be moved relative to the track base 10 smoothly to adjust the position of the positioning mount 20A relative to the track base 10.

Figure 7:
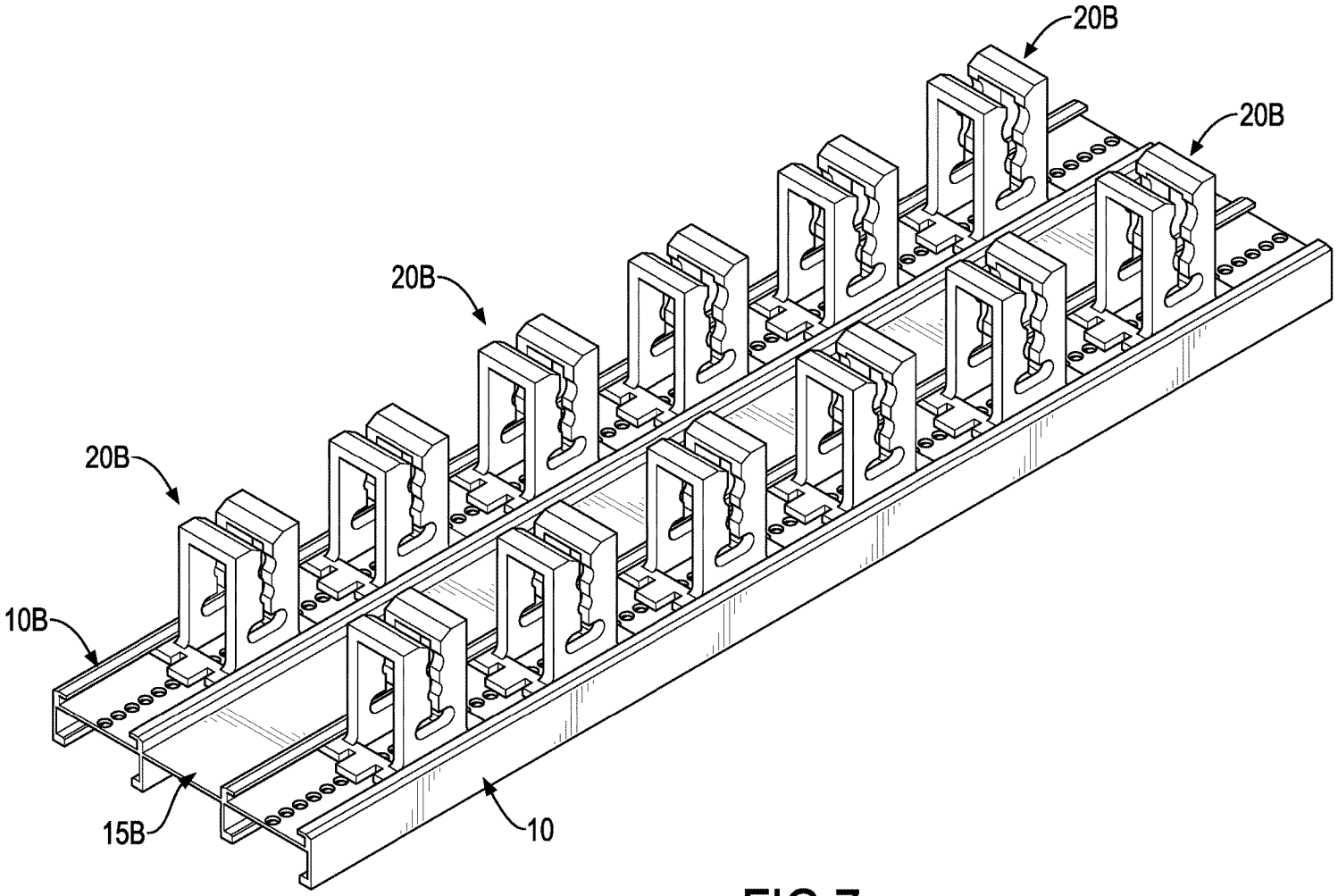
FIG. 7 is a perspective view of a third embodiment of a hand tool frame in accordance with the present invention.
Figure 8:
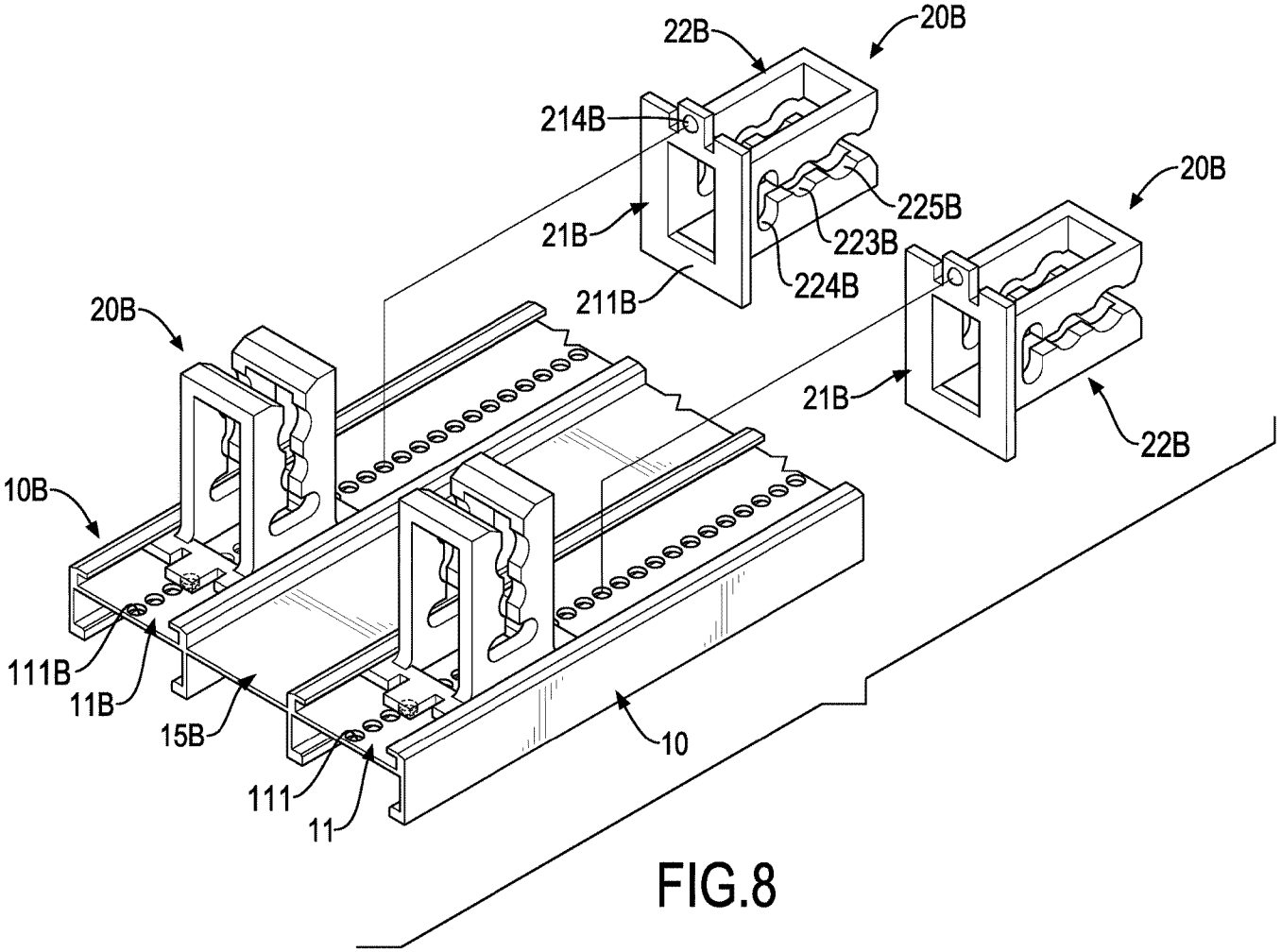
FIG. 8 is an enlarged and exploded perspective view of the hand tool frame in FIG. 7.

With reference to FIGS. 7 and 8, a third embodiment of a hand tool frame in accordance with the present invention is substantially the same as the first embodiment except for the following features. The hand tool frame has at least one positioning mount 20B. In addition, the hand tool frame further has an extending track base 10B. The extending track base 10B is connected to and parallel with the track base 10 by an extending panel 15B. The extending track base 10B also has a bottom panel 11B. The bottom panel 11B also has a top surface, a bottom surface, a front end, a rear end, and multiple positioning holes 111B. The multiple positioning holes 111B are formed through the bottom panel 11B at spaced intervals between the front end and the rear end of the bottom panel 11B.

Each one of the at least one positioning mount 20B is mounted in the track base 10 or the extending track base 10B, and each one of the at least one positioning mount 20B has a sliding seat 21B and an extending element 22B. The sliding seat 21B is slidably mounted in the track base 10 or the extending track base 10B.

Figure 9:
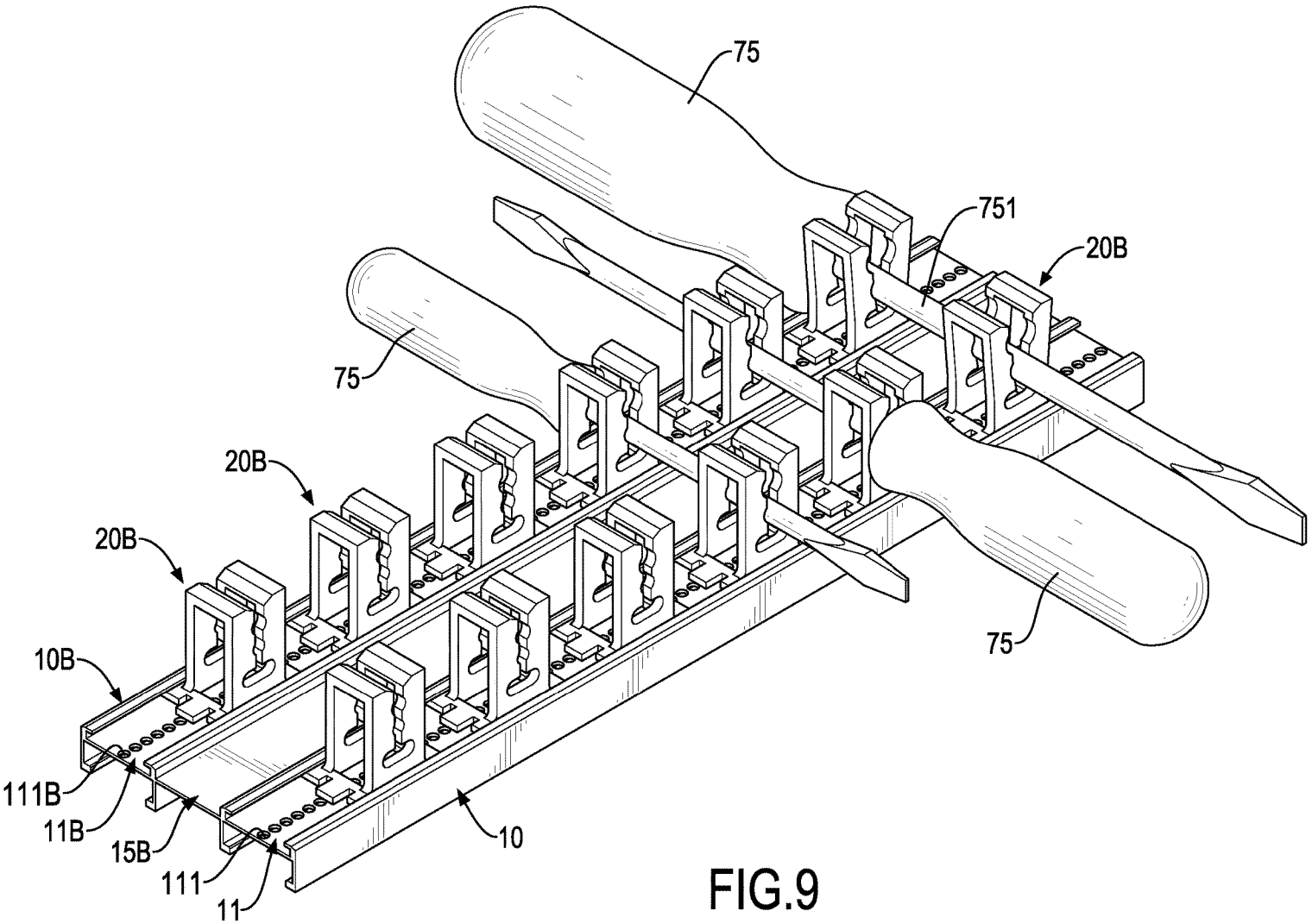
FIG. 9 is an operational perspective view of the hand tool frame in FIG. 7, shown with screwdrivers mounted on the hand tool frame.

The extending element 22B is a hollow block, is formed on the top surface of the body 211B of the sliding seat 21B, and has two sidewalls, a top side, at least one tool hole 223B, a tool slot 224B, and a mounting slit 225B. The at least one tool hole 223B is formed through the sidewalls of the extending element 22B to hold a shank 751 of a screwdriver 75 as shown in FIG. 9. The tool slot 224B is formed through the sidewalls of the extending element 22B and communicates with the at least one tool hole 223B. The mounting slit 225B is formed through the top side and the sidewalls of the extending element 22B, communicates with the at least one tool hole 223B, and is opposite to the tool slot 224B.

With reference to FIG. 9, when the hand tool frame of the third embodiment in the present invention is in use, a shank 751 of a screwdriver 75 is inserted into two positioning mounts 20B that are respectively mounted in the track bases 10, 10B and align with each other via the mounting slits 225B of the extending elements 22B, and is held between two tool holes 223B of the extending elements 22B. Since the positioning mounts 20B are securely mounted on the track bases 10, 10B by the multiple positioning holes 111, 111B and the engaging segment 214B, the screwdriver 75 may be securely held on the track bases 10, 10B of the hand tool frame, and this may also improve the practicality of the hand tool frame.

Figure 10:
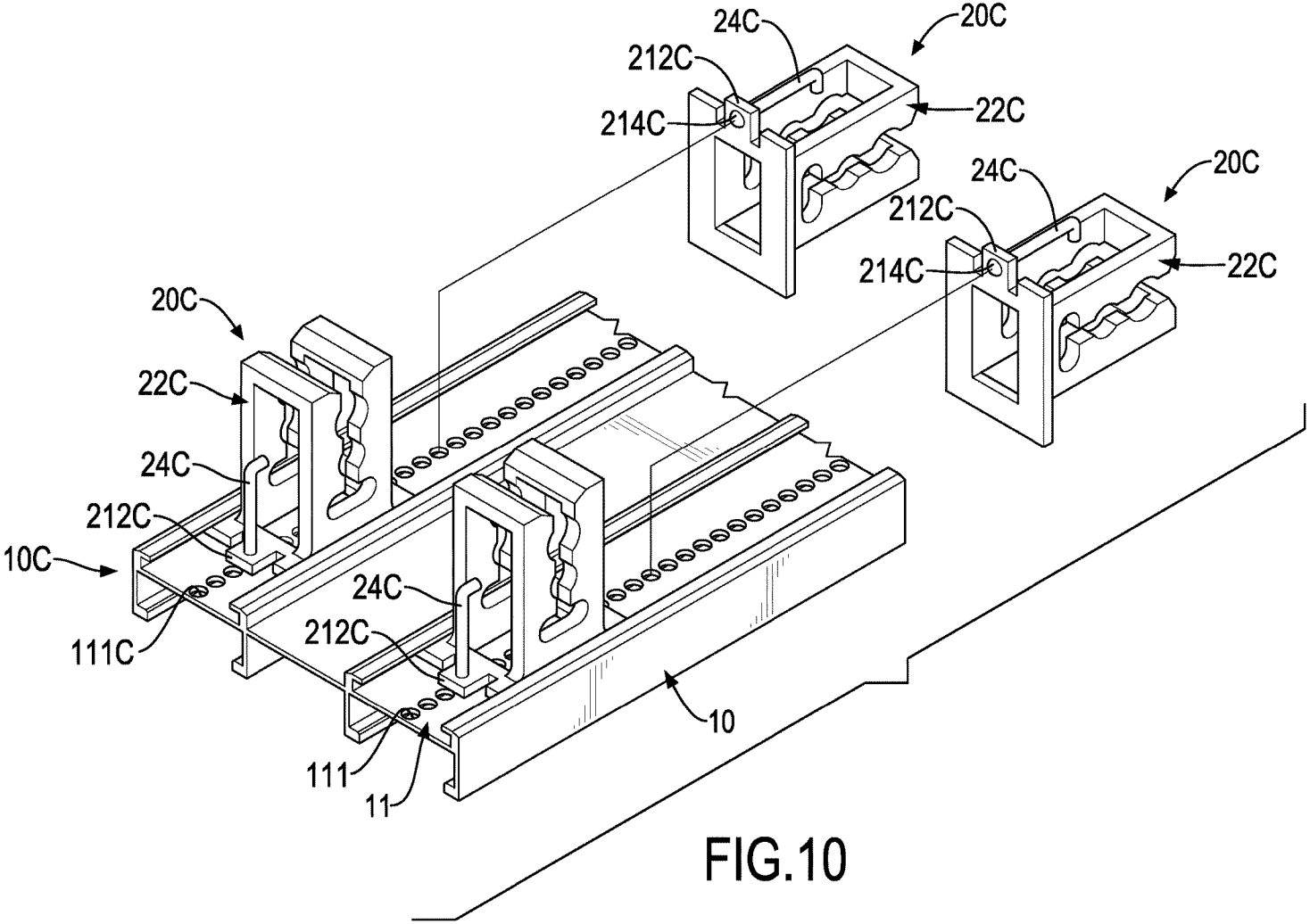
FIG. 10 is an enlarged and exploded perspective view of a fourth embodiment of a hand tool frame in accordance with the present invention.

With reference to FIG. 10, a fourth embodiment of a hand tool frame in accordance with the present invention is substantially the same as the third embodiment except for the following features. Each one of the at least one positioning mount 20C further has a pressing arm 24C. The pressing arm 24C is formed on and protrudes upwardly from the top surface of the positioning portion 212C, and is L-shaped.

Figure 11:
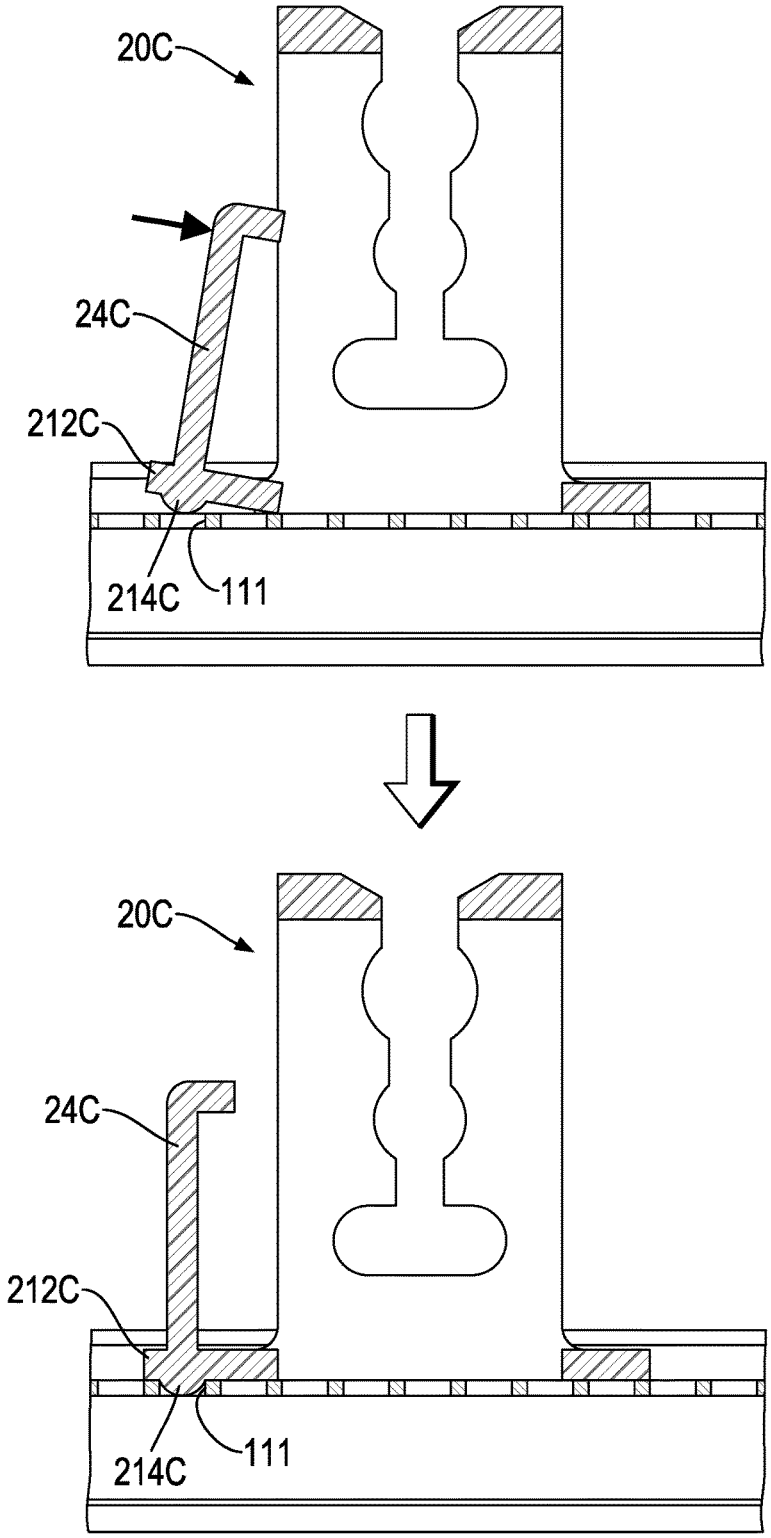
FIG. 11 is an operational and enlarged side view of the hand tool frame in FIG. 10.

With reference to FIGS. 10 and 11, when the hand tool frame of the fourth embodiment in the present invention is in use, a user may press the pressing arm 24C of the positioning mount 20C toward the extending element 22C, and the positioning portion 212C moves upwardly, and this makes the engaging segment 214C disengage from a corresponding positioning hole 111, 111C. Therefore, the positioning mount 20C may move relative to the track base 10 or the extending track base 10C smoothly to adjust the position of the positioning mount 20C relative to the track base 10 or the extending track base 10C.

Figure 12:
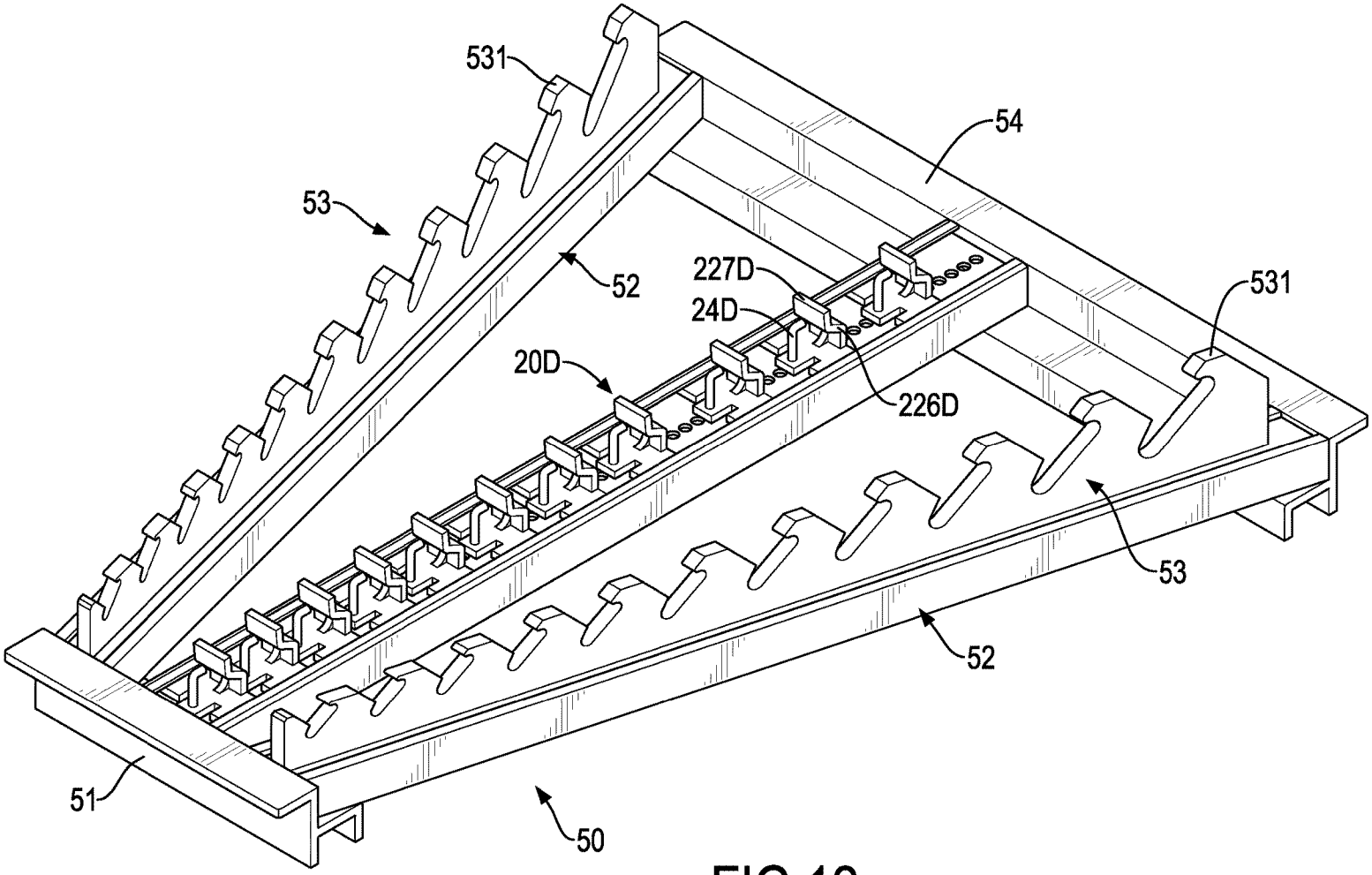
FIG. 12 is a perspective view of a fifth embodiment of a hand tool frame in accordance with the present invention.
Figure 13:
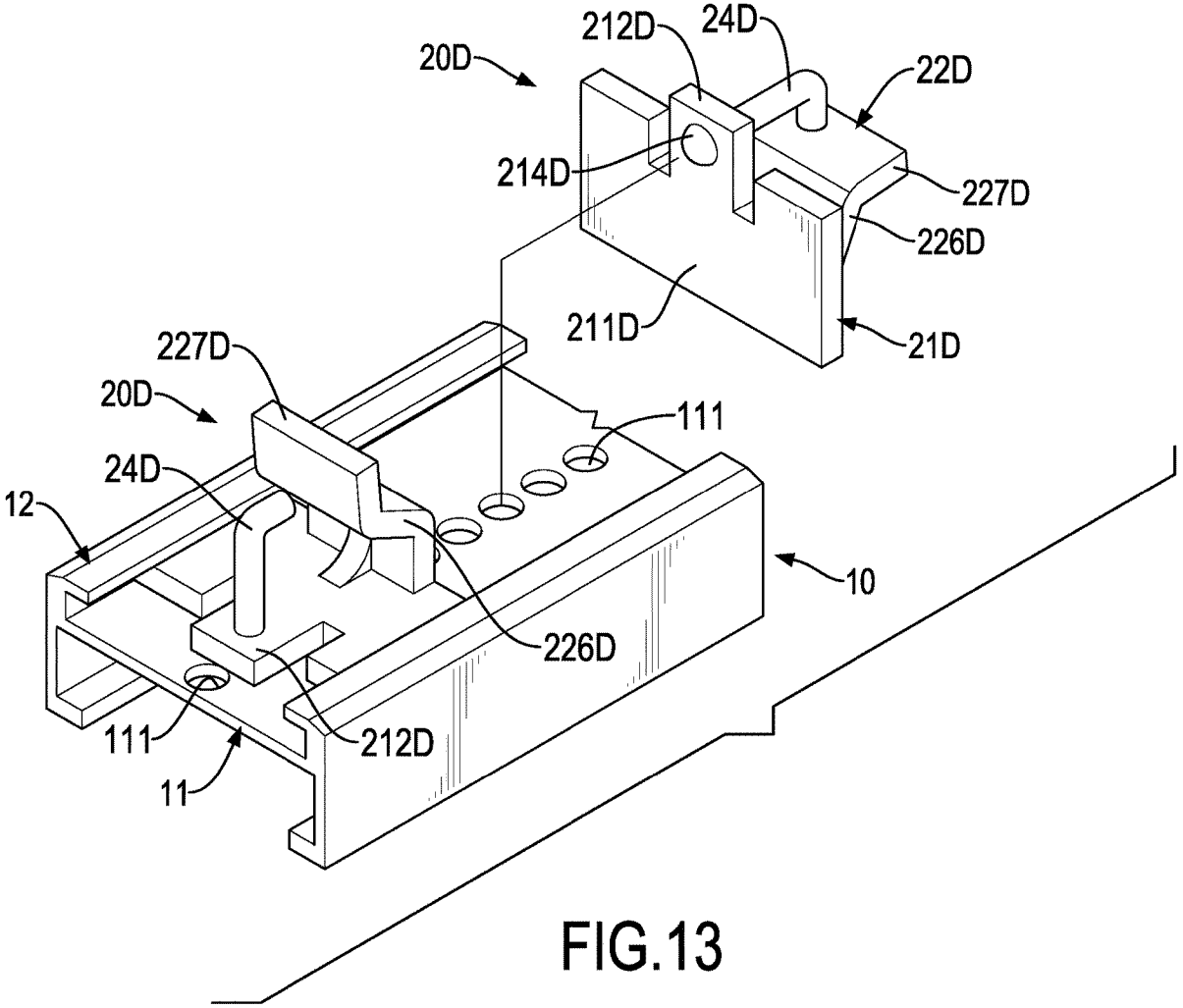
FIG. 13 is an enlarged and exploded perspective view of the hand tool frame in FIG. 12.

With reference to FIGS. 12 and 13, a fifth embodiment of a hand tool frame in accordance with the present invention is substantially the same as the first embodiment except for the following features. The tool frame has at least one positioning mount 20D. The hand tool frame further has an outer frame 50 connected to the track base 10 and having a first supporting mount 51, two side supporting racks 52, two clamping panels 53, and a second supporting mount 54.

The first supporting mount 51 is connected to a front end of the track base 10 to provide a holding effect to a user and has a length. The side supporting racks 52 are connected to the first supporting mount 51 beside the track base 10. The clamping panels 53 are respectively mounted in the side supporting racks 52, and each one of the clamping panels 53 has multiple clamping claws 531 continuously formed on a top side of the clamping panel 53 and extending out of a corresponding side supporting rack 52. The second supporting mount 54 is connected to a rear end of the track base 10, is connected to the side supporting racks 52, and has a length longer than the length of the first supporting mount 51. Then, the outer frame 50 is formed as a trapezoid frame by the supporting mounts 51, 54 and the side supporting racks 52.

Figure 14:
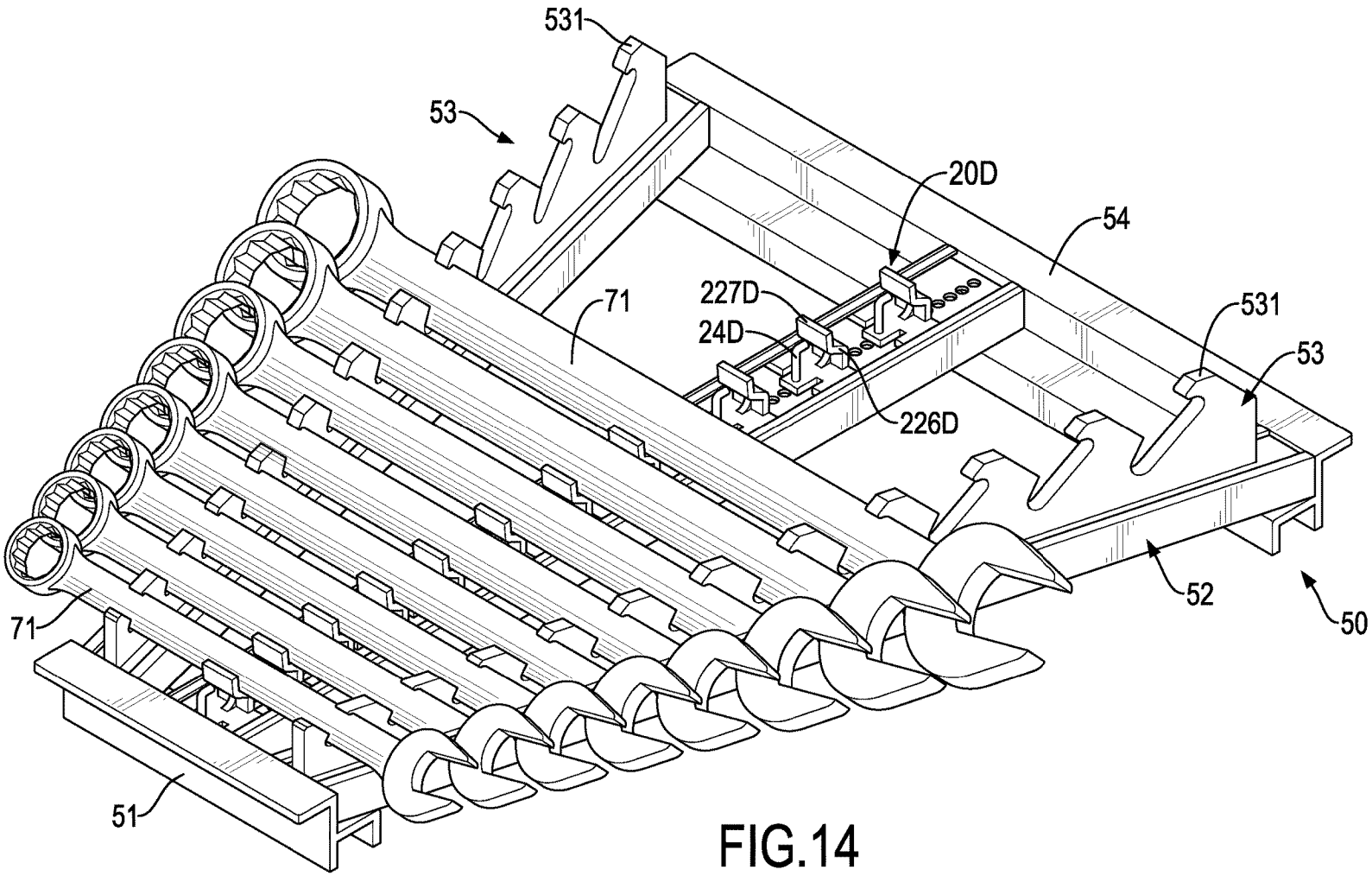
FIG. 14 is an operational perspective view of the hand tool frame in FIG. 12, shown with wrenches of different sizes mounted on the hand tool frame.
Figure 15:
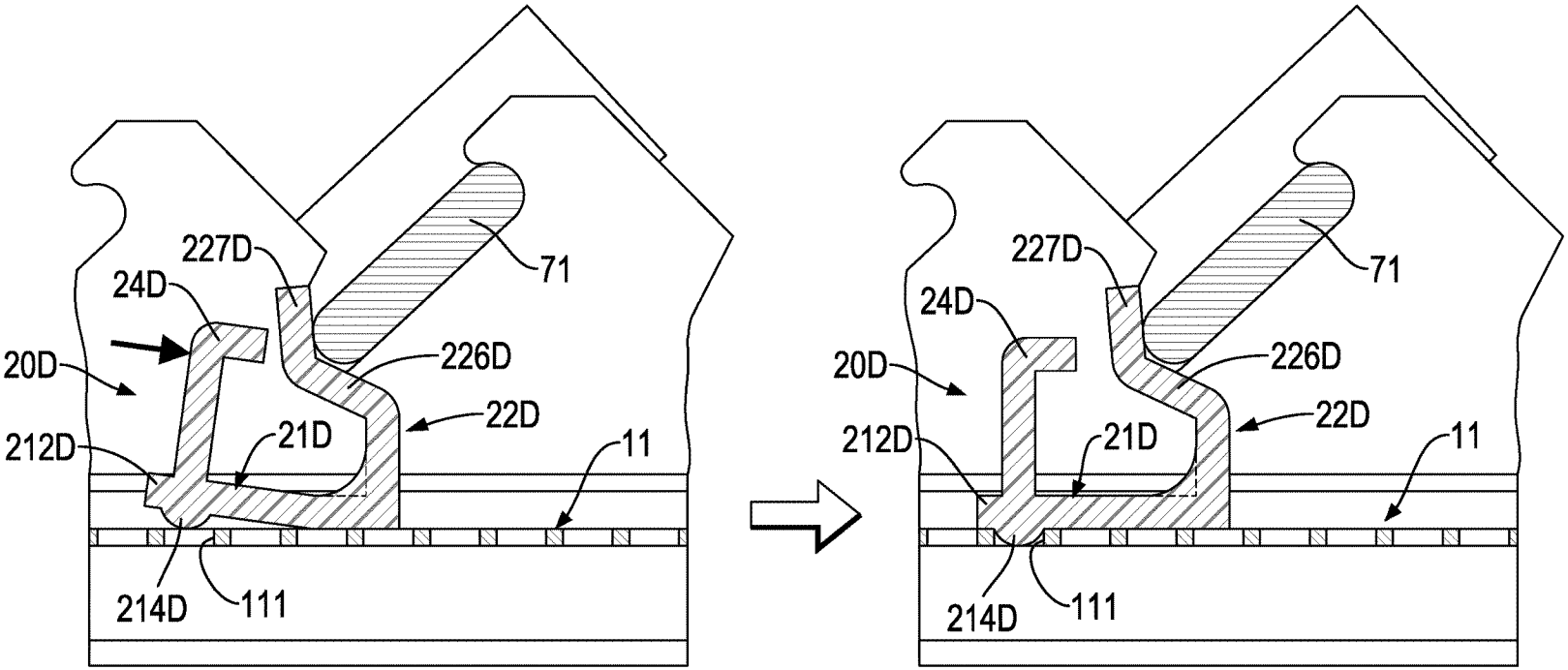
FIG. 15 is an operational and enlarged side view of the hand tool frame in FIG. 14.

Each one of the at least one positioning mount 20D further has a pressing arm 24D. The extending element 22D is an elastic arm, is formed on the top surface of the body 211D of the sliding seat 21D, and has a curved segment 226D and a limiting segment 227D. The curved segment 226D is curvedly formed on and protrudes from the sliding seat 21D and has a free end extending out of the slide rail 12. The limiting segment 227D is formed on and protrudes from the free end of the curved segment 226D of the elastic arm to abut against a combination spanner 71 as shown in FIGS. 14 and 15. The pressing arm 24D is formed on and protrudes upwardly from the top surface of the positioning portion 212D, and is L-shaped.

With reference to FIG. 14, when combination spanners 71 of different sizes are mounted on the fifth embodiment of the hand tool frame, the combination spanners 71 are held in the clamping claws 531 of the clamping panels 53, and the position of the extending element 22D of each one of the positioning elements 20D may be adjusted by releasing the engagement between the multiple positioning holes 111 of the bottom panel 11 and each one of the positioning mounts 20D, and moving the positioning mounts 20D relative to the track base 10 to enable the limiting segment 227D of the elastic arm to move close to and abut against a corresponding combination spanner 71. Furthermore, the curved segment 226D of the elastic arm may be elastically deformed to closely abut against a corresponding combination spanner 71. Then, the combination spanners 71 of different sizes can be securely held on the hand tool frame between the clamping claws 531 of the clamping panels 53 and the positioning elements 20D, and this also can improve the practicality of the hand tool frame.

With reference to FIG. 15, when the hand tool frame of the fifth embodiment in the present invention is in use, a user may press the pressing arm 24D of the positioning mount 20D toward the extending element 22D, and the positioning portion 212D move upwardly, and this makes the engaging segment 214D disengage from a corresponding positioning hole 111 of the bottom panel 11. Therefore, the positioning mount 20D may move relative to the track base 10 smoothly to adjust the position of the positioning mount 20D relative to the track base 10.

Figure 16:
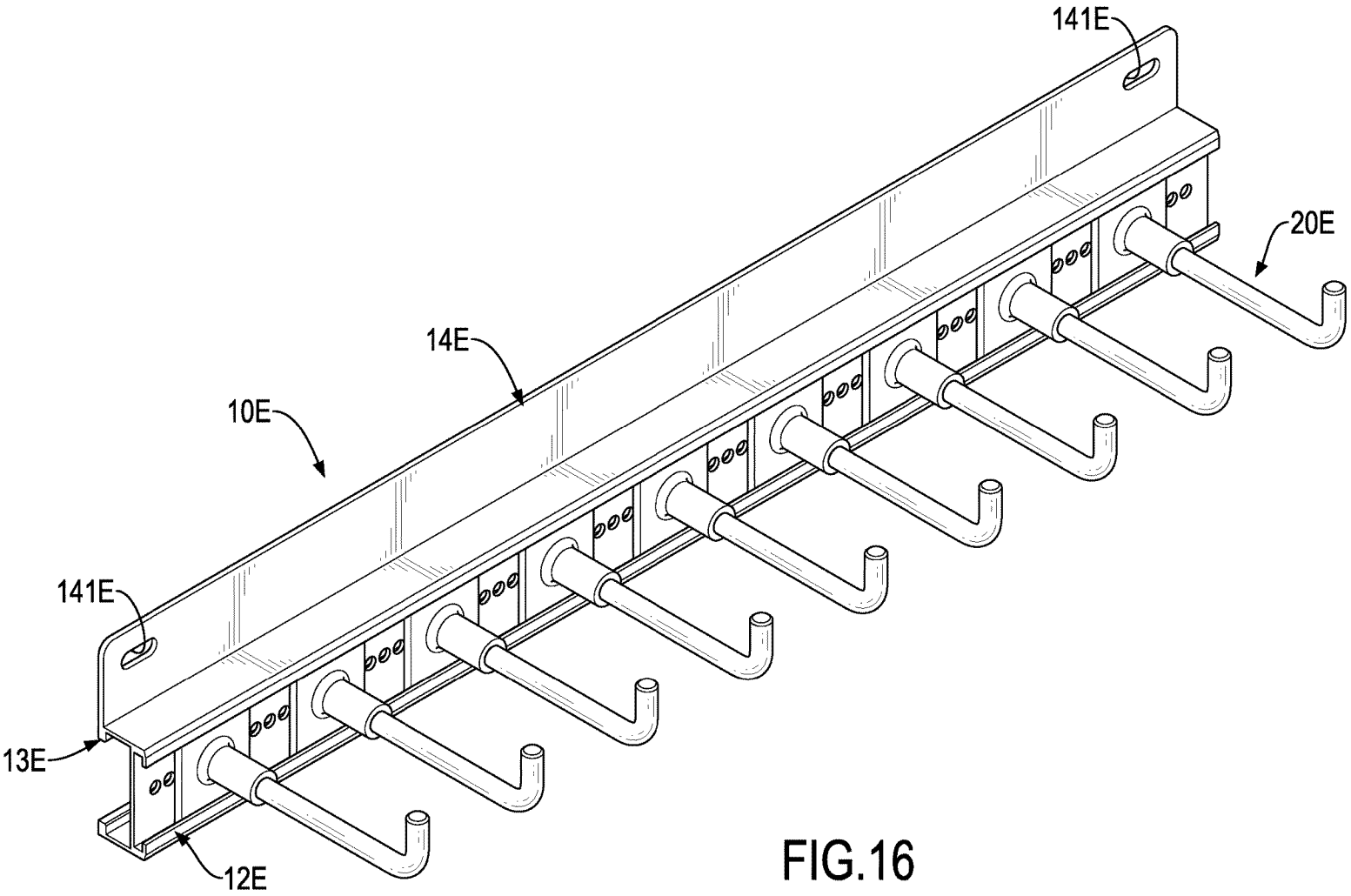
FIG. 16 is a perspective view of a sixth embodiment of a hand tool frame in accordance with the present invention.
Figure 17:
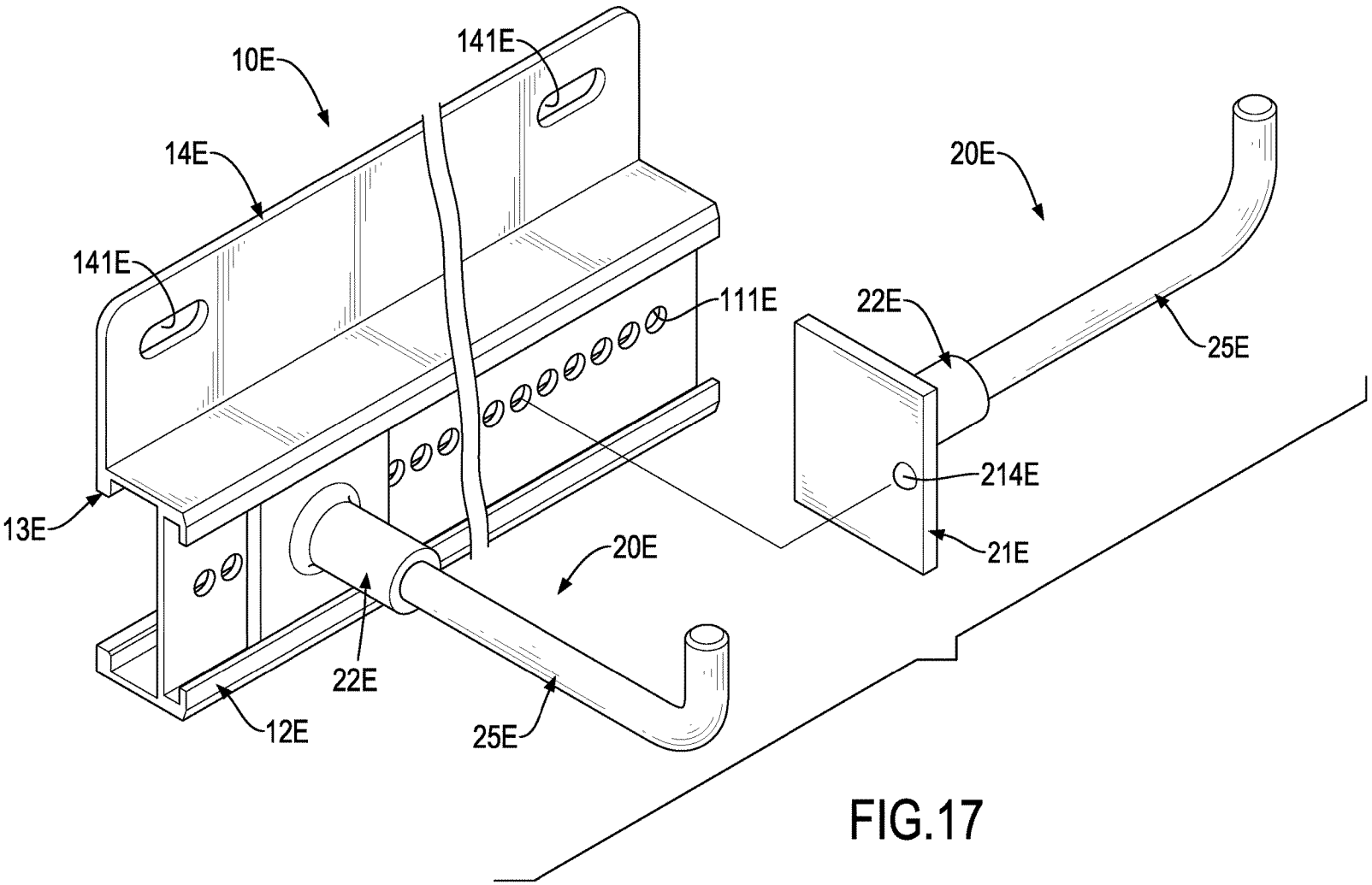
FIG. 17 is an enlarged and exploded perspective view of the hand tool frame in FIG. 16.

With reference to FIGS. 16 and 17, a sixth embodiment of a hand tool frame in accordance with the present invention is substantially the same as the first embodiment except for the following features. The track base 10E of the hand tool frame further has an extending panel 14E. The extending panel 14E is connected to the closed track 13E and has two through holes 141E. The two through hole 141E are formed through the extending panel 14E, and are respectively adjacent to the front end and the rear end of the track base 10E.

The at least one positioning mount 20E is slidably mounted in the track base 10E, and each one of the at least one positioning mount 20E has a sliding seat 21E, an extending element 22E, and a hooking stick 25E. The sliding seat 21E is slidably mounted in the slide rail 12E of the track base 10E, is a rectangular board, and has a front surface and a rear surface. The engaging segment 214E is formed on and protrudes from the rear surface of the sliding seat 21E. The extending element 22E is formed on and protrudes forwardly from the front surface of the sliding seat 21E, and is tubular. The hooking stick 25E is inserted in the extending element 22E, is L-shaped, and extends out of the slide rail 12E.

Figure 18:
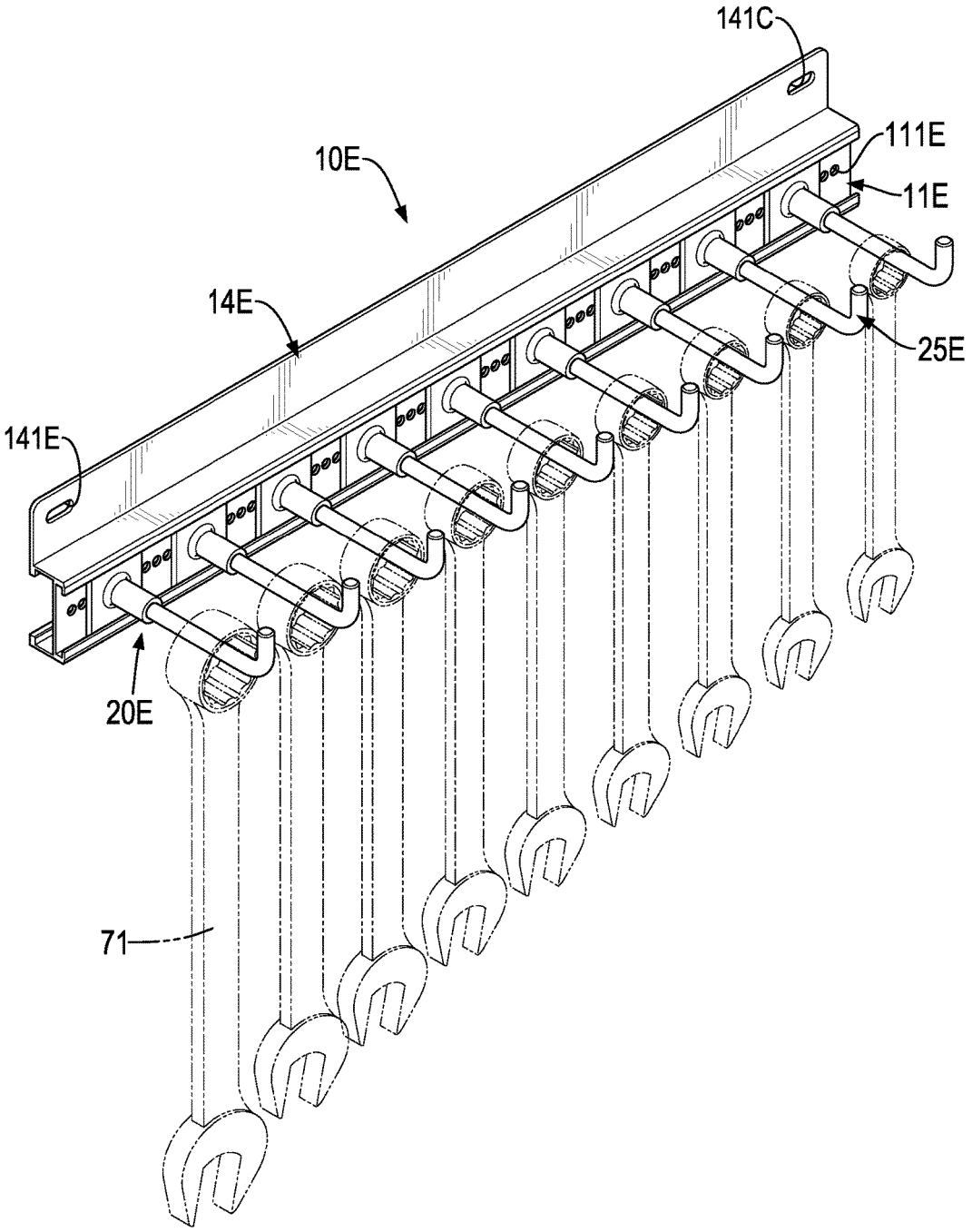
FIG. 18 is an operational perspective view of the hand tool frame in FIG. 16, shown with combination spanners of different sizes mounted on the hand tool frame.
Figure 19:
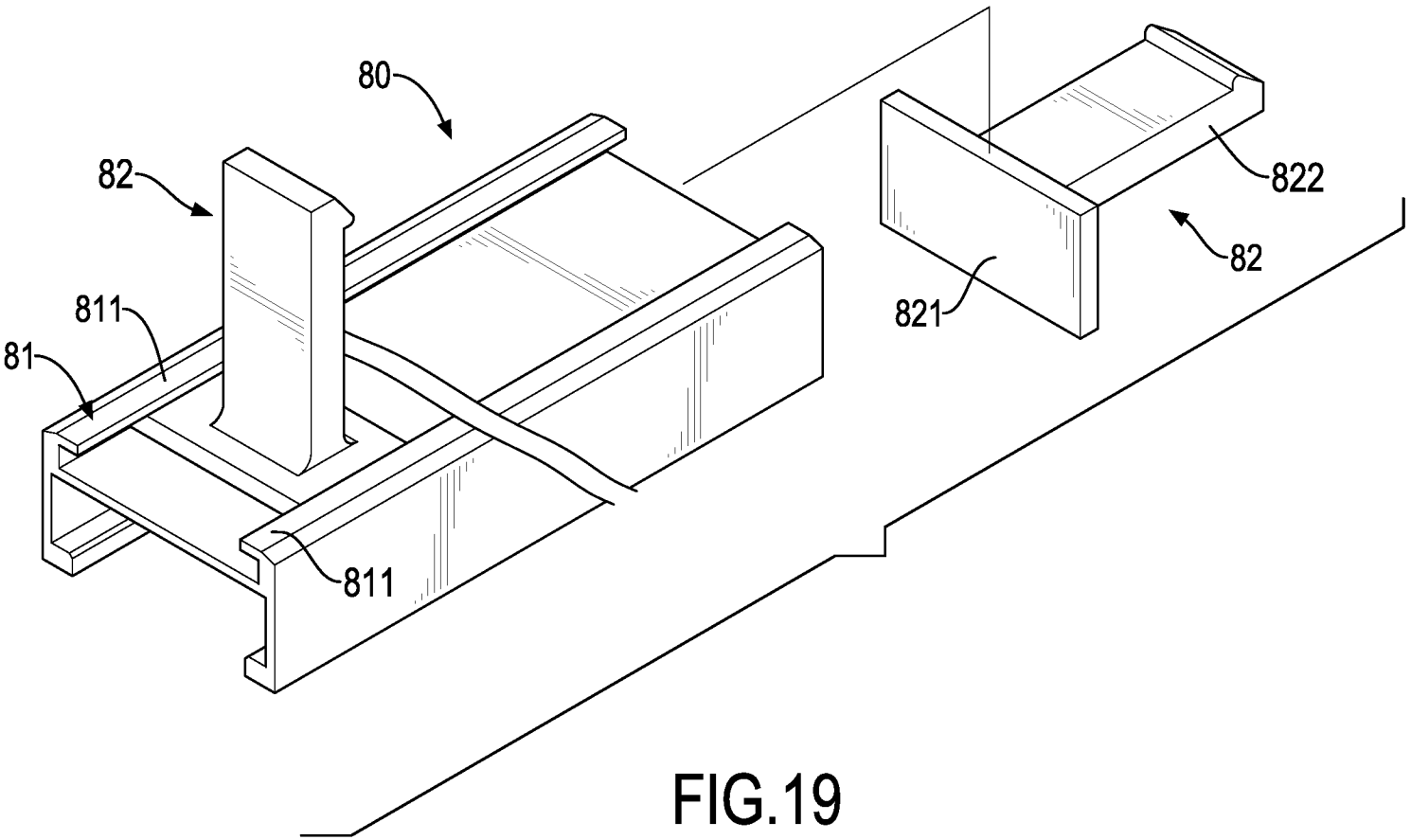
FIG.19 PRIOR ART
FIG. 19 is an enlarged and exploded perspective view of a hand tool frame in accordance with the prior art.
Figure 20:
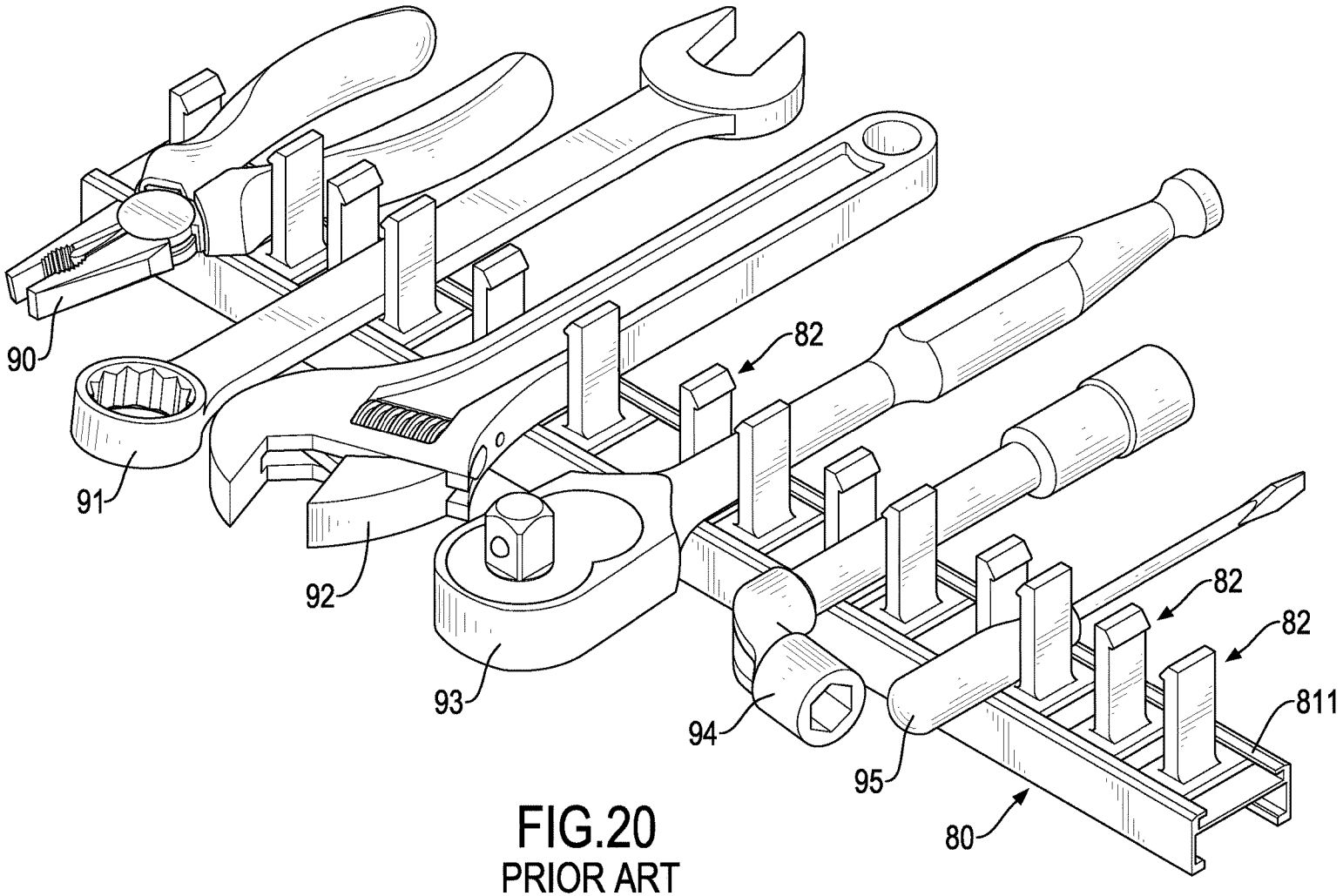
FIG.20 PRIOR ART
FIG. 20 is an operational perspective view of the hand tool frame in FIG. 19, shown with pliers, combination spanners, adjustable wrenches, socket wrenches, hexagonal wrenches, and screwdrivers mounted on the hand tool frame.

With reference to FIG. 18, when combination spanners 71 of different sizes are mounted on the sixth embodiment of the hand tool frame, the combination spanners 71 are hung on the hooking sticks 25E, and the position of the hooking stick 25E may be adjusted by releasing the engagement between the multiple positioning holes 111E of the bottom panel 11E and each one of the at least one positioning mount 20E.

What is claimed is:

1. A hand tool frame comprising:

a track base being an elongated seat and having a bottom panel being elongated and having a top surface;

a bottom surface;
a front end;
a rear end; and
multiple positioning holes formed through the bottom panel at spaced intervals between the front end and the rear end of the bottom panel; and
a slide rail formed on and protruding from the top surface of the bottom panel between the front end and the rear end of the bottom panel and having
a top side;
a top opening formed through the top side of the slide rail; and
a sliding recess formed in the slide rail between the top side of the slide rail and the top surface of the bottom panel and communicating with the top opening and the multiple positioning holes; and
at least one positioning mount slidably mounted on the track base, and each one of the at least one positioning mount having
a sliding seat slidably mounted in the sliding recess of the slide rail and engaging one of the multiple positioning holes and having
a body being U-shaped and slidably mounted in the sliding recess of the slide rail and having
a bottom surface facing the sliding recess of the slide rail and abutting the top surface of the bottom panel;
a top surface facing the top opening of the slide rail;
two free ends; and
a middle segment formed between the two free ends;
a positioning portion formed on and protruding from the middle segment of the body, being elastic, and having a bottom surface and a top surface;
two engaging slots respectively formed through the body between the free ends of the body and the positioning portion; and
an engaging segment formed on and protruding downwardly from the bottom surface of the positioning portion, the engaging segment selectively engaging with one of the multiple positioning holes of the bottom panel; and
an extending element formed on and protruding upwardly from the sliding seat and extending out of the slide rail via the top opening to provide a tool-holding effect.

2. The hand tool frame as claimed in claim 1, wherein
the hand tool frame has at least one pair of said at least one positioning mount; and
the extending element of each one of the at least one pair of positioning mounts is a clamping arm and has
a free end extending out of the slide rail via the top opening; and
a holding hook formed on the free end of the extending element, and the holding hooks of the at least one pair of positioning mounts facing to each other.

3. The hand tool frame as claimed in claim 2, wherein
the extending element has
an inner surface, the inner surfaces of the extending elements of the at least one pair of positioning mounts facing each other; and
an outer surface being opposite to the inner surface; and
each one of the at least one pair of the positioning mounts has a supporting rib formed on the top surface of the body and the outer surface of the extending element.

4. The hand tool frame as claimed in claim 3, wherein each one of the at least one pair of positioning mounts has a pressing arm formed on and protruding upwardly from the top surface of the positioning portion.

5. The hand tool frame as claimed in claim 1, wherein the hand tool frame further has
an extending track base connected to and being parallel with the track base by an extending panel, and having
a bottom panel being elongated and having
a top surface;
a bottom surface;
a front end;
a rear end; and
multiple positioning holes formed through the bottom panel at spaced intervals; and
a slide rail formed on and protruding from the top surface of the bottom panel between the front end and the rear end of the bottom panel and having
a top side;
a top opening formed through the top side of the slide rail; and
a sliding recess formed in the slide rail between the top side of the slide rail and the top surface of the bottom panel and communicating with the top opening and the multiple positioning holes.

6. The hand tool frame as claimed in claim 5, wherein the extending element of each one of the at least one positioning mount is a hollow block, is formed on the top surface of the body of the sliding seat, and has
two sidewalls;
a top side;
at least one tool hole formed through the sidewalls of the extending element to hold a shank of a screwdriver;
a tool slot formed through the sidewalls of the extending element and communicating with the at least one tool hole; and
a mounting slit formed through the top side and the sidewalls of the extending element, communicating with the at least one tool hole, and being opposite to the tool slot.

7. The hand tool frame as claimed in claim 6, wherein each one of the at least one positioning mount has a pressing arm formed on and protruding upwardly from the top surface of the positioning portion.

8. The hand tool frame as claimed in claim 1, wherein the hand tool frame further has an outer frame connected to the track base and having
a first supporting mount connected to a front end of the track base to provide a holding effect to a user and having a length;
two side supporting racks connected to the first supporting mount beside the track base;
two clamping panels respectively mounted in the two side supporting racks, and each one of the clamping panels having multiple clamping claws continuously formed on a top side of the clamping panel and extending out of a corresponding side supporting rack; and
a second supporting mount connected to a rear end of the track base, connected to the side supporting racks, and having a length longer than the length of the first supporting mount to form a trapezoid shape of the outer frame between the supporting mounts and the side supporting racks.

9. The hand tool frame as claimed in claim 8, wherein the extending element of each one of the at least one positioning mount is an elastic arm, is formed on the top surface of the body of the sliding seat, and has
a curved segment curvedly formed on and protruding from the sliding seat and having a free end extending out of the slide rail; and a limiting segment formed on and protruding from the free end of the curved segment of the extending element.

10. The hand tool frame as claimed in claim 9, wherein each one of the at least one positioning mount has a pressing arm formed on and protruding upwardly from the top surface of the positioning portion.

* * * * *